US007210272B2

(12) United States Patent
Friday

(10) Patent No.: US 7,210,272 B2
(45) Date of Patent: May 1, 2007

(54) INTERIOR WALL TRIM SYSTEM

(76) Inventor: Robert E. Friday, 5640 Camarrio Ct., Etiwanda, CA (US) 91739

( * ) Notice: Subject to any disclaimer, the term of this patent is extended or adjusted under 35 U.S.C. 154(b) by 114 days.

(21) Appl. No.: 11/010,214

(22) Filed: Dec. 10, 2004

(65) Prior Publication Data

US 2005/0155312 A1 Jul. 21, 2005

Related U.S. Application Data

(60) Provisional application No. 60/532,539, filed on Dec. 24, 2003.

(51) Int. Cl.
*E04B 2/00* (2006.01)
*E06B 1/04* (2006.01)
*E04C 2/38* (2006.01)

(52) U.S. Cl. ..... 52/288.1; 52/211; 52/718.04

(58) Field of Classification Search ..... 52/287.1, 52/288.1, 211, 212, 204.53, 586.1, 586.2, 52/656.4, 656.5, 716.1, 718.01, 718.02, 718.03, 52/716.8, 717.01, 718.04, 718.05, 716.6, 52/716.7; 403/381
See application file for complete search history.

(56) References Cited

U.S. PATENT DOCUMENTS 2,069,289 A * 2/1937 Swendsen et al. ..... 52/288.1
2,994,905 A * 8/1961 Franker, Jr. ..... 52/273
3,365,854 A * 1/1968 Gallo ..... 52/718.05
4,621,471 A * 11/1986 Kuhr et al. ..... 52/288.1
4,642,957 A * 2/1987 Edwards ..... 52/242
4,856,253 A * 8/1989 Jou ..... 52/718.05
5,179,811 A * 1/1993 Walker et al. ..... 52/288.1
5,359,817 A * 11/1994 Fulton ..... 52/288.1
5,555,688 A * 9/1996 Logan ..... 52/288.1
5,651,224 A * 7/1997 Brabant ..... 52/288.1
5,688,569 A * 11/1997 Gilmore et al. ..... 428/31
5,711,123 A * 1/1998 Lamont et al. ..... 52/287.1
D485,622 S * 1/2004 Sudano ..... D25/119

* cited by examiner

*Primary Examiner*—Naoko Slack
*Assistant Examiner*—Elizabeth A. Plummer
(74) *Attorney, Agent, or Firm*—Boniard I. Brown

(57) ABSTRACT

A trim assembly for interior walls of buildings has a cornerpiece configured for retention in a corner between intersecting walls, a trim strip extending from each opposite side of the cornerpiece, a tang extending from each opposite side of the cornerpiece and extending into slots in respective trim strips, a block member at each opposite side of the cornerpiece, at least one post extending from at least one of the block members and into a slot in a decorative member, and a clip device disposed about the post to retain it in the slot to retain the decorative member relative to the block member.

21 Claims, 7 Drawing Sheets

INTERIOR WALL TRIM SYSTEM

RELATED APPLICATIONS

This application claims benifit of Provisional Application No. 60/532,539, filed Dec. 24, 2003, entitled "Interior Wall Trim System".

BACKGROUND AND SUMMARY OF THE INVENTION

The present invention provides components and features which enable a non-expert person to install trim assemblies for interior walls in a building such as a house without requiring specialized skills and special equipment.

The present invention enables an unskilled person, such as a homeowner, to install trim assemblies between interior walls and ceilings.

The prior art ordinarily requires a person with certain expertise and utilizing specialized equipment to install such trim assemblies.

Preferred embodiments of the trim assemblies for interior walls and ceilings, include trim strips at opposite sides of a cornerpiece, and a tang extending from respective opposite sides of the cornerpiece into slots in respective trim strips. A block member is disposed at each of the opposite sides of a cornerpiece, and at least one post extends from one or more block members into respective slots in decorative members, and clips to retain the posts in slots to retain decorative members.

Tangs extend oppositely from respective sides of the cornerpiece and into slots in respective decorative strips. The clips are preferably of a T-shaped configuration and have outwardly extending portions to engage in slots to retain the posts.

One or more tangs extend from each block member and into the slots in the cornerpiece. Other tangs extend from each block member oppositely from said first tang members and into slots in respective trim strips at opposite sides of the cornerpiece.

Clip members are disposed at respective posts to retain the posts in respective slots to retain the decorative member.

The block members are preferably secured at an intersection between a ceiling and walls by clip members on posts extending into slots in the wall.

In embodiments of generally rectilinear arrangements, as about a door or window, a plurality of corner members are disposed at intersections of elongate members.

Each corner member has at least one tang extending from two adjacent sides and into elongate members to attach them together, the elongate members having end portions thereon at least one post extending into a slot in a trim member with clip means to retain the trim member in the slots.

DESCRIPTION OF THE PREFERRED EMBODIMENTS

Figure 1:
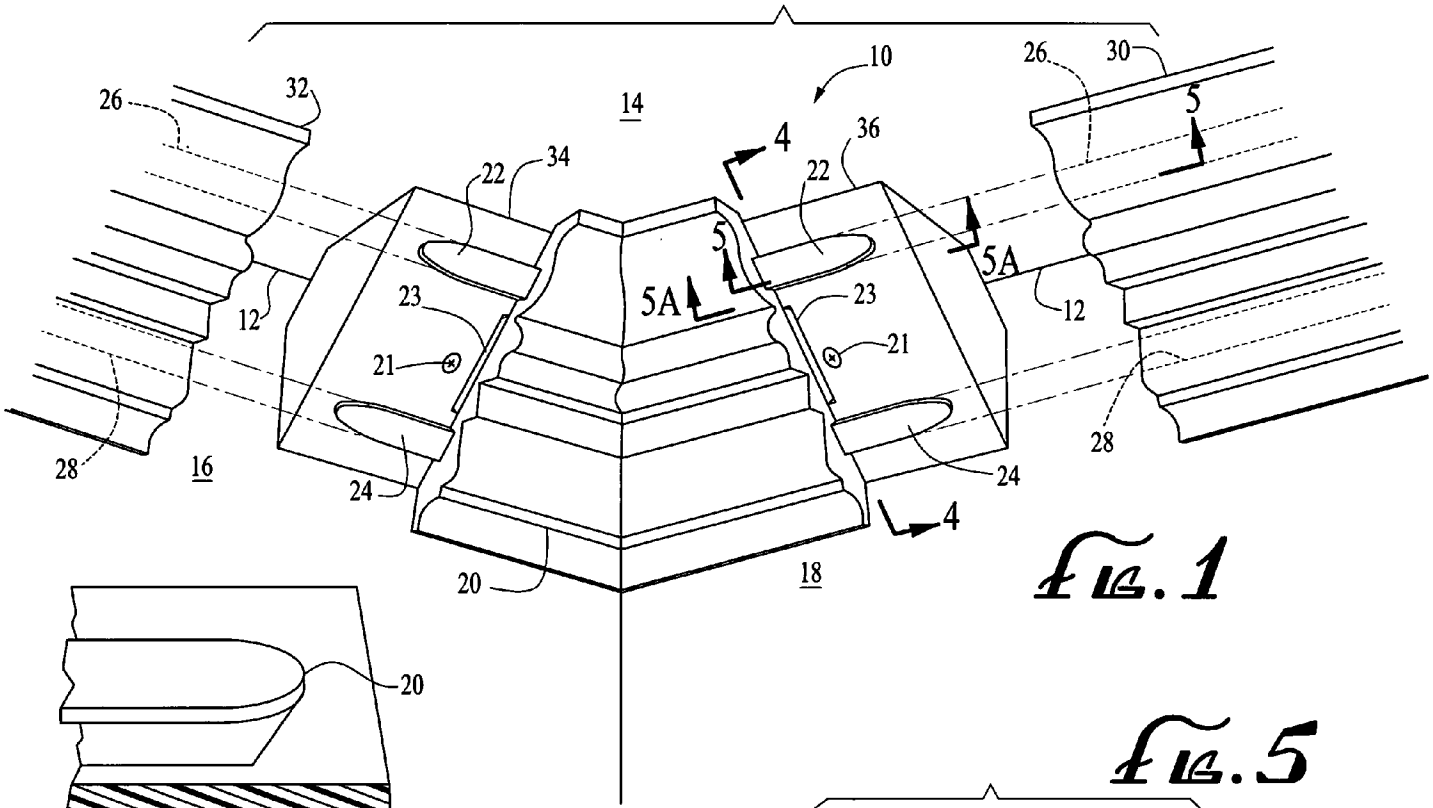
FIG. 1 is an exploded perspective view of a preferred embodiment of the invention, as viewed from below, showing the mounting thereof in corners between walls and ceiling.

Referring to the drawings, a preferred embodiment 10 of the invention is shown in FIGS. 1 through 5. FIG. 1 is a view upwardly toward an intersection 12 between a ceiling 14 and walls 16, 18.

Figure 4:
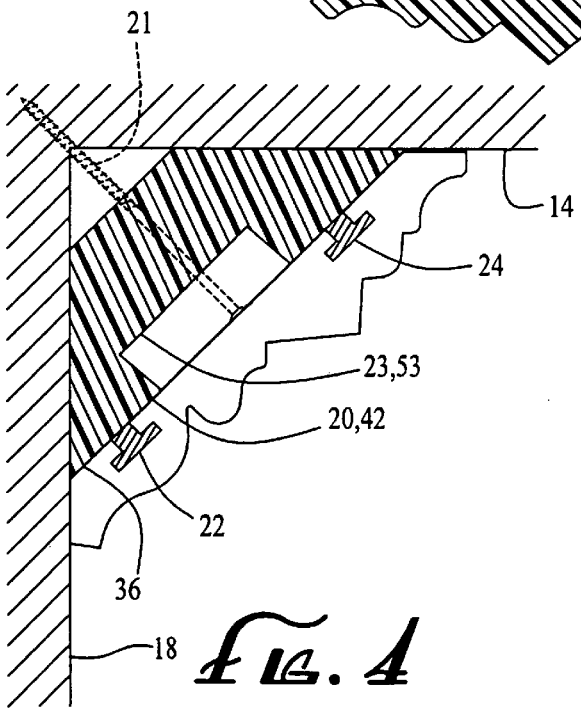
FIG. 4 is a sectional view taken at line 4—4 in FIG. 1.

A corner member 20 is secured in a corner between walls 16 and 18, as by a screw 21, referring to FIG. 4 which extends into the corner defined between the wall 18 and ceiling 14. The corner member is self-centering during its installation and is readily urged into the corner without fumbling or complications. If there is no wood or other material disposed at the corner to receive a screw, a separate member (not shown) may be positioned behind the intersecting walls to receive the screw.

Figure 5:
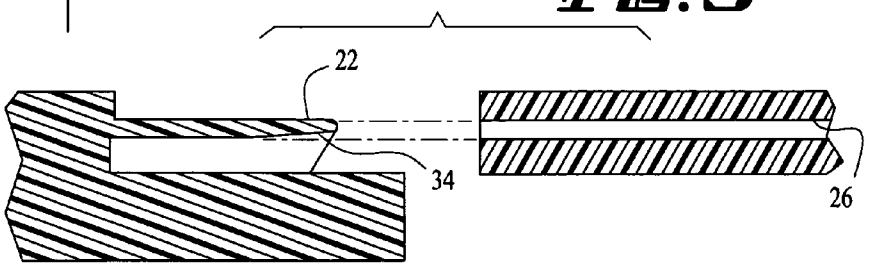
FIG. 5 is a sectional view taken at line 5—5 in FIG. 1 showing a tang component in relation to a slot defined in an adjacent decorative molding section.
Figure 5A:
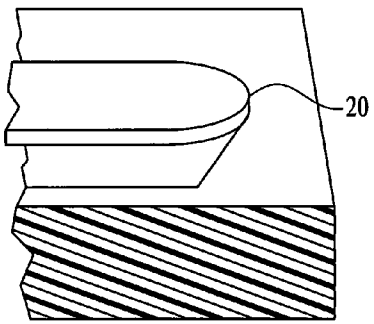
FIG. 5A is a sectional view taken at line 5A—5A in FIG. 1, showing a tang utilized with the invention.
Figure 2:
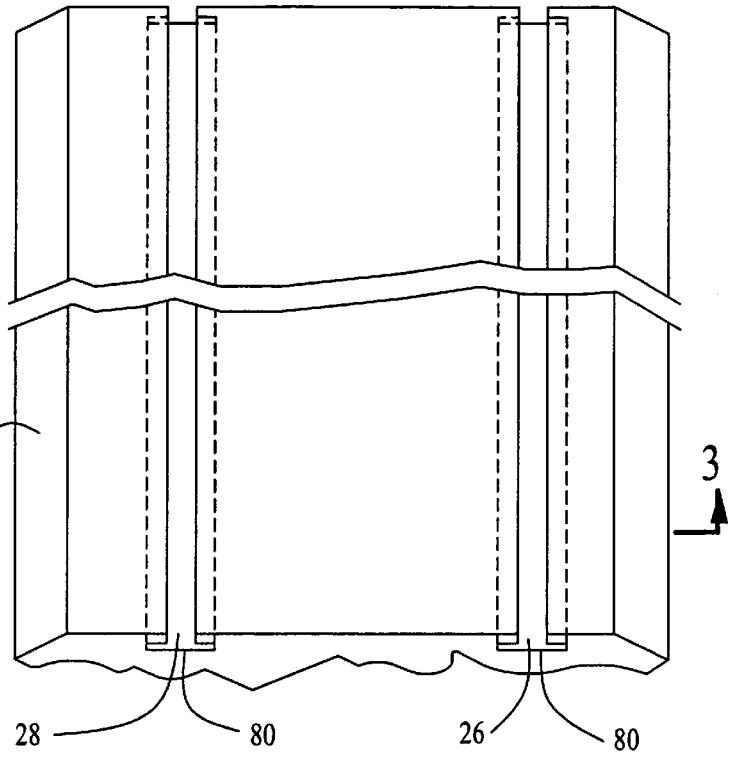
FIG. 2 is a perspective view of the decorative molding section of FIG. 3.
Figure 3:
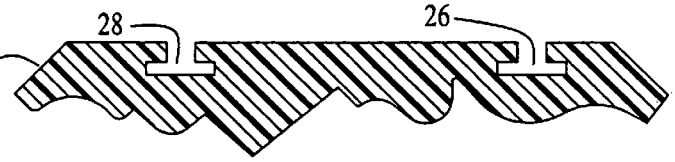
FIG. 3 is a sectional view taken at line 3—3 in FIG. 2.

The corner-piece member has tangs extending therefrom, and typically molded integrally therewith, one pair of spaced-apart tangs 22, 24 extending from each side of the corner-piece member 20, as shown. These tangs extend into passages 26, 28 in the oppositely extending molding sections 30, 32. The tangs are T-shaped in cross-section, as indicated in FIG. 5 and FIG. 5A. The outer portion of the tangs may be tapered, as indicated in FIG. 5, to facilitate entry of the upper portions of respective tangs into the slots or passages 26, 28 in the molding sections 30, 32. Two blocks 34, 36 are secured to a wall by screws 21 and are adjacent to the opposite sides of the corner-piece member 20, and are integral with the corner-piece, as shown.

Figure 6:
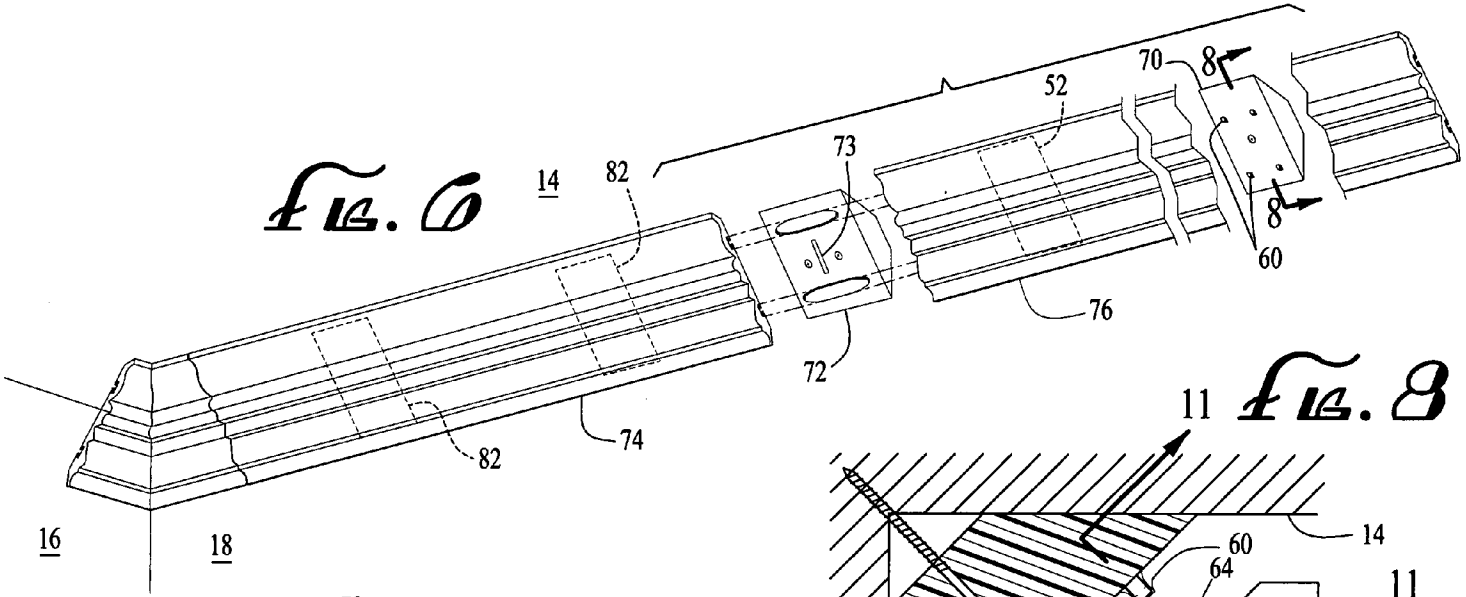
FIG. 6 is a perspective view of a second embodiment of the present invention.
Figures 9, 10, 11, 12:
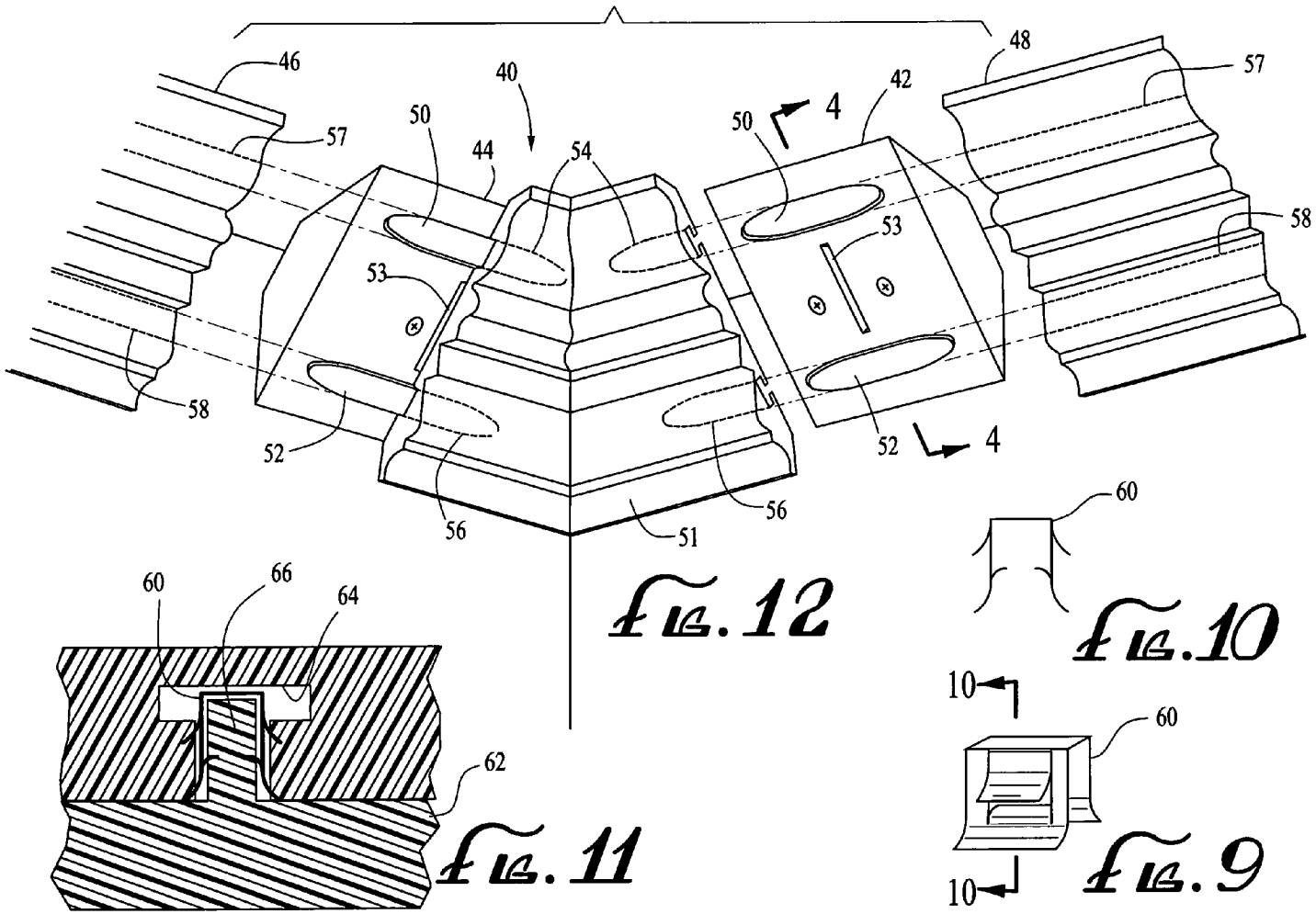
FIG. 9 is a perspective view of a leaf spring component utilized with the invention.
FIG. 10 is an end view of the leaf spring device of FIG. 9.
FIG. 11 is an enlarged sectional view taken at line 11—11 in FIG. 8.
FIG. 12 is an exploded perspective view of a third embodiment of the present invention, viewed from below, showing it mounted between a ceiling and intersecting walls.

A slot 23 is defined in block portions 34, 36 in FIG. 1 and at 53 in block portions in FIG. 12 and at 73 in FIG. 6, into which an end portion of a measuring tape may be retained, as by force-fitting, thus to enable one person to use the measuring tape without requiring a second person to grip and hold the opposite end of a tape.

FIG. 12 shows an alternate embodiment 40 of the invention which is somewhat simpler than the embodiment of FIG. 1, and somewhat simpler to use and install. FIG. 12 is an exploded perspective view of components according to the invention mounted between a ceiling and intersecting walls. In this embodiment, two blocks 42, 44 are adjacent respectively to the respective ends of molding sections 46, 48, which molding sections are typically 8'–10' long. The blocks 42, 44 may be utilized with specially made cornerpiece 51.

The type of corner member shown will function as an outside corner as well as an inside corner. Tangs 50 similar to those of FIGS. 1, 5 and 5A are mounted on the blocks 42, 44. The blocks 42, 44 may have such width or be narrowed as required in particular installations.

Referring to FIG. 12, each block is slid into one end of the cornerpieces and provides an arrangement similar to that of FIG. 1. The tangs 50, 52 on the respective blocks extend into sockets 54, 56 in the cornerpiece. It may be appropriate to extend the sockets further into the cornerpiece than shown because it may be less expensive to thus provide the sockets.

The tangs on blocks 42, 44 enter into passages or sockets 57, 58 in the respective 8'–10' long molding sections 46, 48, the sockets being shown in broken lines at 57, 58.

Figure 8:
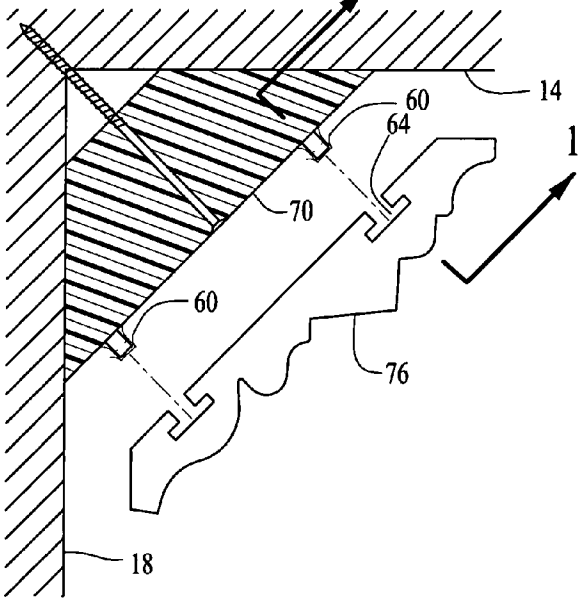
FIG. 8 is an enlarged sectional view taken at line 8—8 in FIG. 6.
Figure 7:
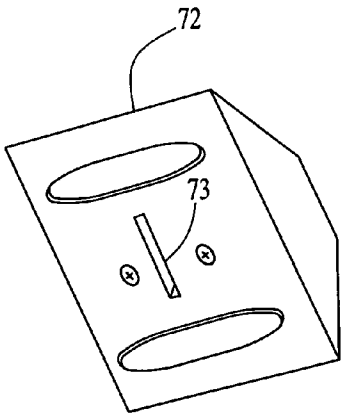
FIG. 7 is a perspective view of a mounting block utilized with the embodiment of FIG. 6.

A third embodiment of the invention is illustrated in FIGS. 6, 7 and 8. This embodiment includes a cornerpiece similar to that of FIG. 12. In FIG. 6, there is shown a block 72, similar to block 42 of the embodiment of FIG. 12, and like block 42 has thereon two tangs to engage in slots or passages (not shown) in adjacent molding sections 74, 76 in the manner in which the tangs of the embodiment of FIG. 1 extend into the passages or slots indicated in FIG. 1 by broken lines. As with FIG. 1, the molding section is typically 8'–10' long and comprise decorative molding.

The broken line showings or areas 82 of FIG. 6 represent spaced-apart members like member 70, which are secured, as by screws, to a wall and attached by posts with leaf springs thereon extending into T-shaped slots such as are shown in FIGS. 9, 10 and 11.

FIGS. 8 to 11 illustrate certain components relative to the embodiment of FIG. 6. Spring components are provided on posts to engage in openings or grooves, in the manner indicated in FIG. 11. FIGS. 9 and 10 show the leaf spring components 60 in perspective and in sectional views, and a spring component 60 is shown in FIG. 11 engaged about a post 66 engaged in a T-shaped slot 64, with the leaf spring portions engaging the side walls of the slot to retain member 62 in the slot, as shown. FIG. 11 is an enlarged sectional view taken at line 11—11 in FIG. 8 and showing two posts with leaf spring members 60 thereon in relation to T-shaped slots in a molded decorative section. The spring member 60 snaps in place in the T-shaped slot, thus to retain molded sections in place.

The spring members of FIGS. 9 and 10 are mounted on posts 66 and serve to attach the longitudinal molding pieces to block members such as blocks 70 of FIG. 6 which are secured, as by screws, to a wall on which the longitudinal molding pieces are attached.

With T-shaped grooves 80 in the back side of the decorative longitudinal members when mounted, the decorative molding is on the outer side and the T-shaped grooves are on the inner side and secured by the posts 66 and leaf spring members 60 thereon in position.

The leaf spring members 60 may be fabricated of appropriate plastic, and their configuration may differ somewhat from the configuration of FIGS. 9 and 10.

The decorative moldings must be solidly anchored along their lengths and are supported typically at 16"–24" intervals along the molding as necessitated by the moldings being fairly flexible, being formed of certain plastics, wood, or other appropriate material.

Referring to FIGS. 13 through 16, there are shown components according to the present invention which provide decorative molding about a door or a window.

Blocks 90 have pairs of tangs 92 extending outwardly from adjacent sides of the blocks. The blocks are disposed at upper corners of a door and mid-way adjacent the vertical sides of the door. The tangs 92 extend into appropriate openings in an upper decorative member 94 and into vertical members 93 and 95. The blocks 90 have tangs extending upwardly and laterally to engage outwardly extending decorative strips 96 and vertical strips 93, 95.

Figure 13:
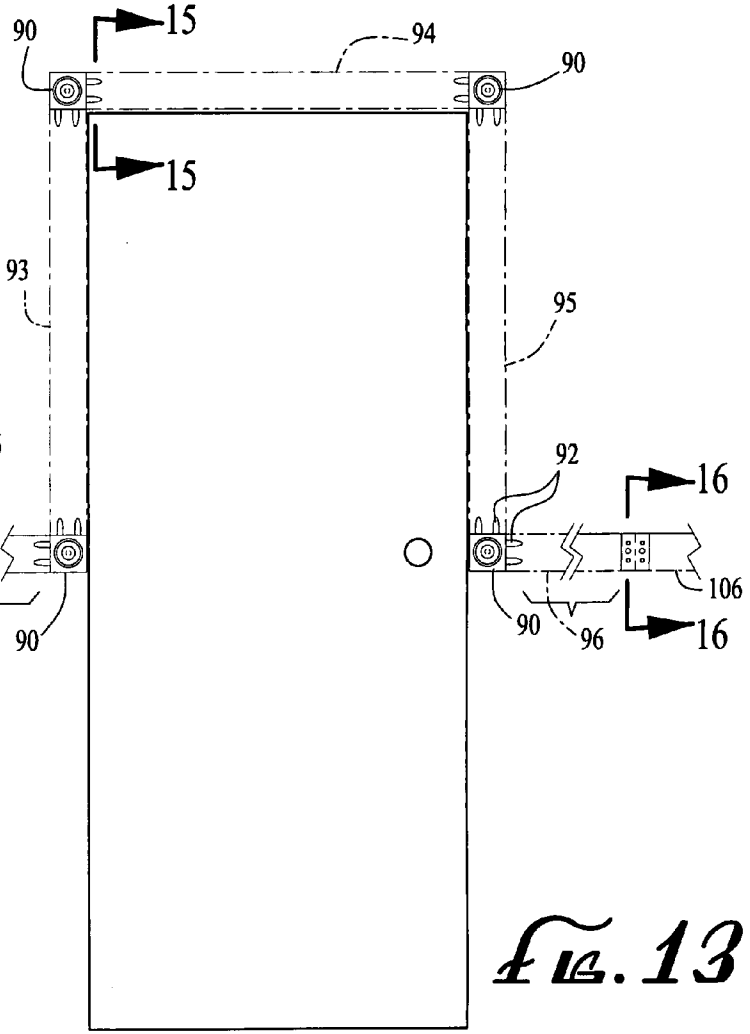
FIG. 13 is an elevational view of a door and decorative components and moldings thereon.
Figure 16:
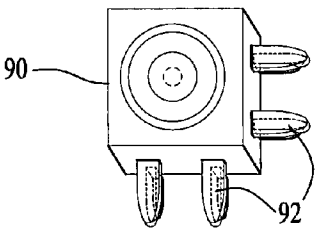
FIG. 16 is an enlarged sectional view taken at line 16—16 in FIG. 13.
Figure 14:
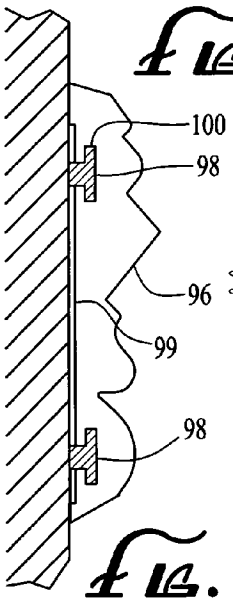
FIG. 14 is a perspective view of a corner block and tangs extending therefrom utilized in the embodiment of FIG. 13.
Figure 15:
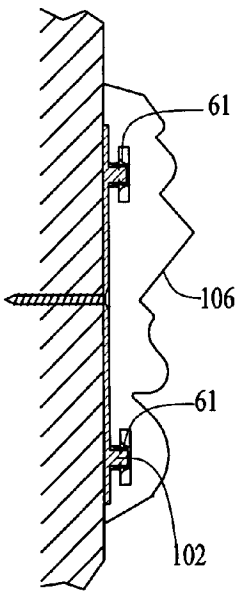
FIG. 15 is an enlarged sectional view taken at line 15—15 in FIG. 13.

FIG. 15, taken at line 15—15 in FIG. 13, shows enlargement of a cross-section of T-shaped slots 98 in a molding and a block 99 having tangs extending from opposite sides thereof, as shown. FIG. 16 shows the engagement of the T-shaped slots 100 of a decorative section, to accommodate posts 102 with spring members thereon.

FIG. 16 shows the utilization of the leaf spring members 60 atop posts 102 and engaged in T-shaped slots 61 to secure a decorative member 106.

Decorative trim is mounted by blocks 90 on which are mounted a plurality of tangs extending from adjacent sides 90° apart, to engage decorative molded sections 93, 94 and 95 by engagement of the tangs thereon in passages or slots in respective decorative mold members.

The tangs engage in slots or openings in the decorative sections or members in a manner similar to that in which the tangs of earlier described embodiments engage in corresponding slots or passages to retain decorative mold sections.

Figure 17:
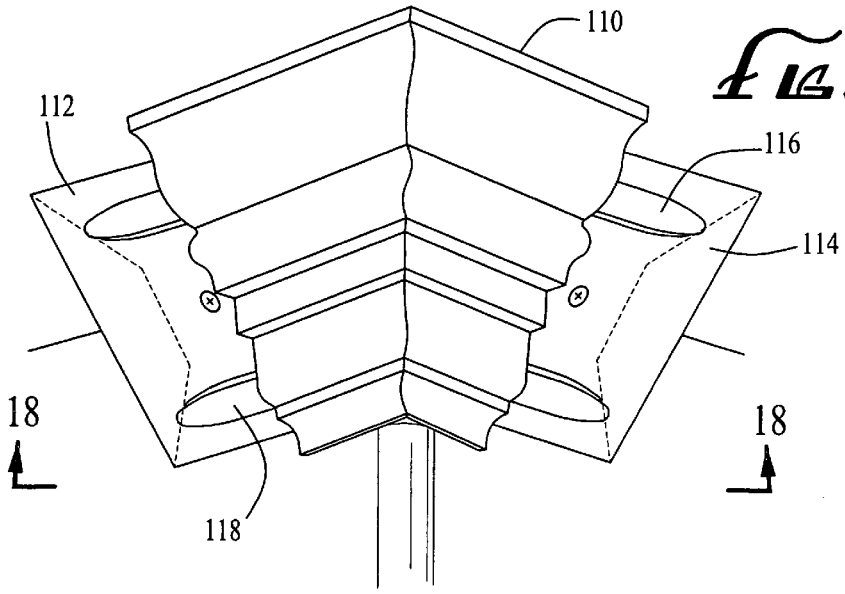
FIG. 17 is a perspective view of an outside corner member with tangs extending therefrom.
Figure 18:
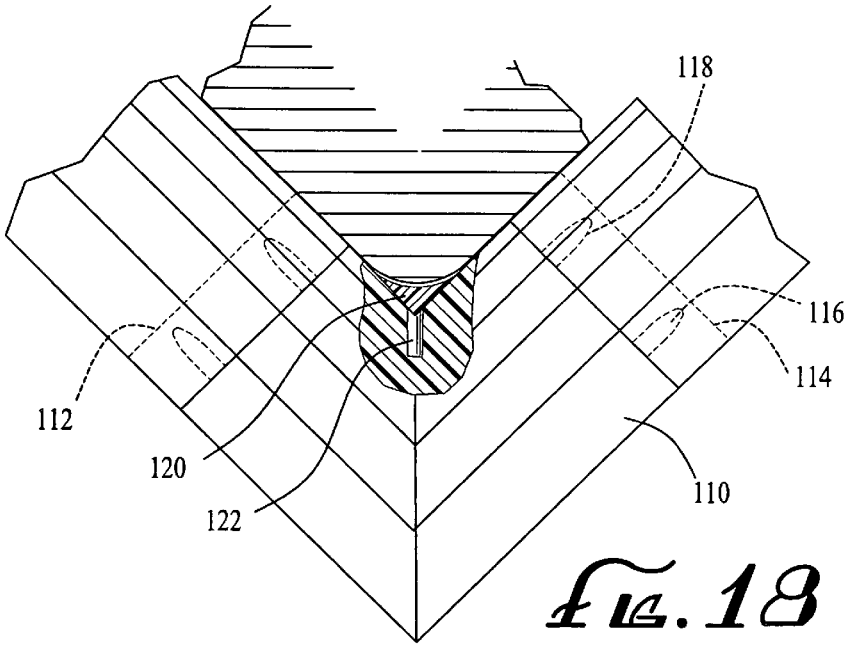
FIG. 18 is an enlarged sectional view taken at line 18—18 in FIG. 17 showing a rounded corner defined by an insertion member.

FIG. 17 is a view of a corner member 110 with members 112, 114 extending therefrom and attached by tangs 116 and 118. FIG. 18 shows an exterior member 110 with block components 112, 114 attached thereto by tangs 116, 118 which extend into passages in the decorative molding as in the embodiment of FIG. 1.

FIG. 18 is a view looking upwardly and is partially in section to show a member 120 of generally triangular configuration with a rounded outer portion or surface. Member 120 fits into a corner, and has a mounting prong or rod portion 122 extending into the corner member, as shown. This arrangement provided by the invention prevents a person or observer, looking upwardly, from seeing any hole or void or rectangular corner. Current house construction tends to eliminate right-angled corners, and instead employ rounded, curvilinear corners.

Figure 19:
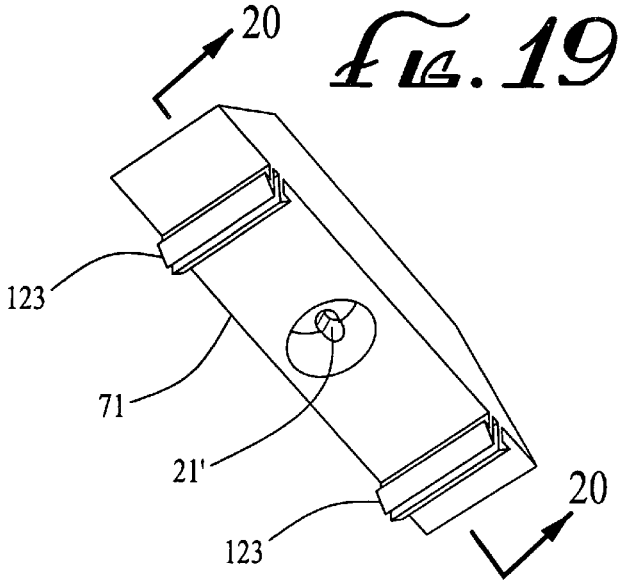
FIG. 19 is a perspective view of resilient elements on a block.

FIG. 19 shows resilient retainer elements 123 serving the function of the leaf spring members 60 (FIGS. 9 and 11). They are inserted in the T-shaped slot like post 66 in FIG. 11, the members 123 being urged through the vertical portion of the T-shaped slot 64, and being compressed in passing through the vertical portion of the T-shaped slot and expanding into the upper transverse portion of the T-shaped slot 64 (FIG. 11), thus to retain the member 66 in the T-shaped slot.

Figure 20:
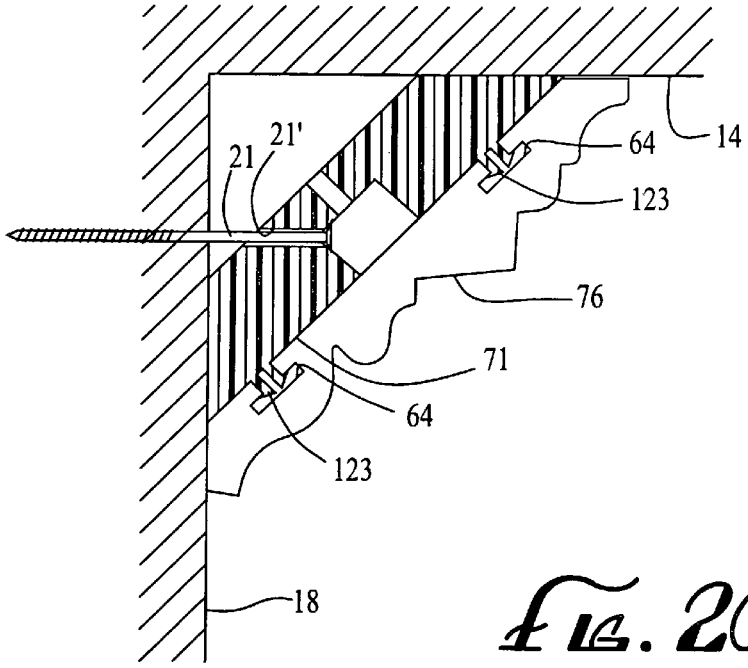
FIG. 20 is a view taken at line 20—20 in FIG. 19.

FIG. 20 is a sectional view taken at line 20—20 in FIG. 19. A threaded fastener or screw 21 extends through a passage 21' which is oriented at a substantial angle relative to the screw of the embodiment of FIG. 8 in order to engage member 18. This arrangement enables the securement of the block 71, and is utilized in the event there is no substantial material or wood for the securement of a screw at the corner where member 71 is positioned.

It will be understood that various changes and modifications may be made from the preferred embodiments discussed above without departing from the scope of the present invention, which is established by the following claims and equivalents thereof.

The inventor claims:

1. A trim assembly for building interior walls, comprising:

at least one cornerpiece configured for retention in a corner between intersecting walls, at least one trim strip disposed at each opposite side of said cornerpiece, at least one tang extending from each of respective opposite sides of said cornerpiece to extend into slots in the respective at least one slot trim strips, at least one block member at each of the opposite sides of the cornerpiece, at least one post extending from at least one of said block members and into a slot in at least one trim strip, and clip means disposed about said at least one post to retain the post in the at least one slot to retain the at least one trim strip.

2. A trim assembly according to claim 1 wherein at least two tangs extend oppositely from each side of the cornerpiece into at least one slot in said at least one trim strip.

3. A trim assembly according to claim 1 wherein said clip means has outwardly extending portions to engage in a wall of said at least one slot to retain the post therein.

4. A trim assembly according to claim 2 wherein end portions of at least some of said at least one tang are tapered to facilitate entry thereof into said at least one slot.

5. A trim assembly according to claim 1 wherein the adjacent ones of said at least one block are integral with said cornerpiece.

6. A trim assembly according to claim 1 wherein said at least one slot is of generally T-shaped configuration.

7. A trim assembly according to claim 1 wherein said clip comprises a leaf spring.

8. A trim assembly according to claim 1 and further comprising a slot in at least one block member to retain an end portion of a measuring tape to enable a person to maneuver the other end of the tape without a second person to grip said end portion.

9. A trim assembly for building interior walls, comprising:

a cornerpiece configured for retention in a corner between intersecting walls, at least one slot defined in each side of said cornerpiece, at least one trim strip disposed at each opposite side of said cornerpiece and having at least one slot therein to receive a tang, at least one block member adjacent each of the opposite sides of the cornerpiece, at least one first tang member extending from at least one of said block members and into respective ones of said at least one slot in the cornerpiece, at least one second tang member extending from at least one of said block members and oppositely from said first tang members into said at least one slot in said respective at least one trim strips at opposite sides of said centerpiece, at least one post extending from at least one of said block members and into a slot in at least one trim strip, and clip means disposed about said at least one post to retain the post in the at least one slot to retain at least one trim strip in the slot.

10. A trim assembly according to claim 9 wherein said at least one block member is separate from said cornerpiece.

11. A trim assembly according to claim 9 wherein said cornerpiece has inclined surfaces to facilitate centering of the cornerpiece in a corner during installation thereof.

12. A trim assembly according to claim 9 wherein said at least one first or at least one second tang are disposed on separate respective opposite block members.

13. A trim assembly according to claim 9 wherein at least certain of said at least one first or at least one second tang are tapered in configuration to facilitate entry into said at least one slot.

14. A trim assembly according to claim 9 wherein said at least one block member is respectively secured at an intersection between a ceiling and a wall by clip members on posts extending into slots in a wall.

15. A trim assembly according to claim 9 wherein clip means extend about respective posts and have outwardly extending spring portions to engage in slots in a wall to retain at least one trim strip.

16. A trim assembly according to claim 9 wherein at least two tangs extend oppositely from each of said at least one block member and into said at least one respective slot in said trim strip.

17. A trim assembly according to claim 9 and further comprising a slot in at least one block member to retain an end portion of a measuring tape to enable a person to maneuver the other end of the tape without a second person to grip said end portion.

18. A trim assembly for an interior wall, comprising:

a plurality of elongate tang members in generally rectilinear arrangement having generally horizontal and vertical members, corner members disposed at respective intersections of said elongate members, each of said corner members having at least one of said members extending from each of two adjacent sides thereof and into end portions of trim members to attach the trim members together, at least one of said elongate tang members having an end portion with at least one post extending into a slot in a trim member, and clip means disposed about said post to retain at least one of said at least one trim members in said slot.

19. A trim assembly according to claim 18 wherein a plurality of said elongate tang members are disposed about a door.

20. A trim assembly according to claim 18 wherein a plurality of said elongate tang members are disposed about a window.

21. A trim assembly according to claim 18 wherein at least two of said elongate tang members extend outwardly from said corner members and into openings in trim members.

* * * * *